US011208305B2

(12) United States Patent
Kerovuori et al.

(10) Patent No.: US 11,208,305 B2
(45) Date of Patent: Dec. 28, 2021

(54) CONTROL OF VERTICAL MOVEMENT OF HOISTING ROPE

(71) Applicant: Konecranes Global Corporation, Hyvinkää (FI)

(72) Inventors: Juhani Kerovuori, Loppi (FI); Atte Lähteenmäki, Tampere (FI)

(73) Assignee: KONECRANES GLOBAL CORPORATION, Hyvinkää (FI)

( * ) Notice: Subject to any disclaimer, the term of this patent is extended or adjusted under 35 U.S.C. 154(b) by 209 days.

(21) Appl. No.: 16/499,156

(22) PCT Filed: Mar. 28, 2018

(86) PCT No.: PCT/FI2018/050232

§ 371 (c)(1),
(2) Date: Sep. 27, 2019

(87) PCT Pub. No.: WO2018/178516

PCT Pub. Date: Oct. 4, 2018

(65) Prior Publication Data

US 2021/0087027 A1 Mar. 25, 2021

(30) Foreign Application Priority Data

Mar. 30, 2017 (FI) ..... 20175299

(51) Int. Cl.
*B66D 1/46* (2006.01)
*B66D 3/18* (2006.01)

(52) U.S. Cl.
CPC ..... *B66D 1/46* (2013.01); *B66D 3/18* (2013.01)

(58) Field of Classification Search
CPC ... B66D 1/40; B66D 1/46; B66D 1/48; B66D 1/485
See application file for complete search history.

(56) References Cited

U.S. PATENT DOCUMENTS 4,151,981 A * 5/1979 Gennep ..... B66D 5/20 188/341
5,458,216 A * 10/1995 Tanaka ..... B66B 5/044 187/373
6,073,496 A * 6/2000 Kuhn ..... B66C 1/40 73/862.56

(Continued)

FOREIGN PATENT DOCUMENTS

CN 101062748 A 10/2007
CN 202201632 U 4/2012

(Continued)

OTHER PUBLICATIONS

International Preliminary Report on Patentability issued in PCT/FI2018/050232 (PCT/IPEA/409), dated May 2, 2019.

(Continued)

*Primary Examiner* — Michael E Gallion
(74) *Attorney, Agent, or Firm* — Birch, Stewart, Kolasch & Birch, LLP

(57) ABSTRACT

A device in connection with a hoisting rope of a hoisting device includes a main suspension element to suspend a sheave or wedge socket supporting the hoisting rope to a fastening structure of a body of the hoisting device and a detector for detecting an external vertical force acting on the hoisting rope.

21 Claims, 4 Drawing Sheets

(56) References Cited

U.S. PATENT DOCUMENTS

| | | | | |
|---|---|---|---|---|
| 6,668,668 | B1 * | 12/2003 | Peshkin | B66C 13/18 324/207.15 |
| 7,070,061 | B1 * | 7/2006 | Munnekehoff | B66C 23/005 212/328 |
| 7,222,839 | B2 * | 5/2007 | Taylor | B66D 1/485 242/563 |
| 7,559,533 | B2 * | 7/2009 | Stockmaster | B66D 3/18 254/270 |
| 10,472,203 | B2 * | 11/2019 | Kattainen | B66B 1/3476 |
| 2003/0025110 | A1 * | 2/2003 | Keith | B66D 3/18 254/334 |
| 2004/0155004 | A1 * | 8/2004 | Laundry | B66D 3/18 212/330 |
| 2008/0265225 | A1 * | 10/2008 | Miyoshi | B66D 3/18 254/266 |
| 2013/0282178 | A1 * | 10/2013 | Freitag | B66D 3/18 700/257 |

FOREIGN PATENT DOCUMENTS

| | | | |
|---|---|---|---|
| CN | 105016233 | A | 11/2015 |
| CN | 105540431 | A | 5/2016 |
| EP | 0839614 | A1 | 5/1998 |
| EP | 1 666 400 | A2 | 6/2006 |
| JP | 9-156886 | A | 6/1997 |
| WO | WO 00/69771 | A1 | 11/2000 |
| WO | WO 01/05697 | A1 | 1/2001 |
| WO | WO 01/46060 | A1 | 6/2001 |

OTHER PUBLICATIONS

International Search Report issued in PCT/FI2018/050232 (PCT/ISA/210), dated Jun. 25, 2018.

Written Opinion of the International Searching Authority issued in PCT/FI2018/050232 (PCT/ISA/237), dated Jun. 25, 2018.

Extended European Search Report for European Application No. 18776385.9, dated Dec. 18, 2020.

* cited by examiner

CONTROL OF VERTICAL MOVEMENT OF HOISTING ROPE

BACKGROUND OF THE INVENTION

The invention relates to hoisting devices and, in particular, to a device, arrangement, and method in connection with a hoisting rope of the hoisting device.

In uses where a load to be lifted is manually fixed to the hoisting rope, the end of the hoisting rope and load fastening means, such as a lifting hook, adapted thereto may be left a bit too high or too low, in which case the fastening of the load to the hoisting rope will be unsuccessful. Controlling an end of a hoisting rope to the exact correct height by a remote controller may be difficult, and an operator's attention may, when working close to the hoisting device, be focused on the remote controller, which may even lead to work safety being jeopardized.

BRIEF DESCRIPTION OF THE INVENTION

An object of the invention is thus to provide a method and equipment implementing the method so as to solve the aforementioned problems. The object of the invention is achieved by a method and system which are characterized by what is disclosed in the independent claims. Preferred embodiments of the invention are disclosed in the dependent claims.

The invention is based on detecting an external vertical force acting on the rope, and controlling the vertical movement of the hoisting rope according to it.

The advantage of the method, device, and system according to the invention is that the movement of the hoisting device may be controlled from the hoisting rope or a load fastening means adapted to it by affecting the hoisting rope with a force directed up or down. In other words, an operator may grab the load fastening means and control the hoisting device by displacing the load fastening means, such as a hook. So, the movement of the hoisting apparatus may be controller without an external controller. This way, a very intuitive user interface may be accomplished for controlling the movement of the hoisting device.

BRIEF DESCRIPTION OF THE FIGURES

The invention will now be described in more detail in connection with preferred embodiments and with reference to the accompanying drawings, in which.

DETAILED DESCRIPTION OF THE INVENTION

Figure 1:
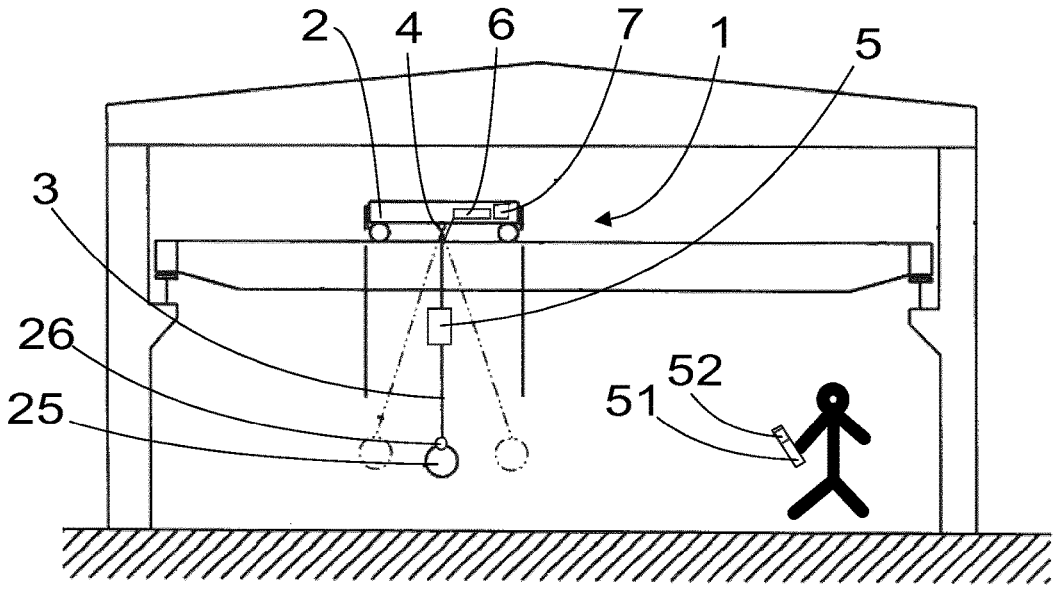
FIG. 1 is a schematic view of a hoisting device.

FIG. 1 is a schematic view of a hoisting device 1. The hoisting device may comprise any hoisting device in which a hoisting rope or a similar structure is used to hoist loads. The hoisting device may comprise a body 2, a hoisting rope 3, a wedge socket 4 for attaching the hoisting rope at one of its ends to the body, a sheave 5 for controlling the hoisting rope, a hoisting mechanism 6 for at least lifting and lowering the hoisting rope, and/or a control unit 7 for controlling the hoisting mechanism. The body 2 may, depending on the embodiment, be fixedly built in its place or it may be a mobile one. The hoisting device 1 may further comprise a device 10, such as a device 10 according to any one of FIGS. 2*a* to 6, or another device described in this description, which may be utilized for controlling the vertical movement of the hoisting rope 3. The hoisting device 1 may further comprise an arrangement 50, such as an arrangement 50 according to FIG. 7, or another arrangement described in this description for controlling the vertical movement of the hoisting rope 3.

Although FIG. 1 is a schematic and very simplified view of a bridge crane, the device, arrangement, and method now disclosed may be utilized in connection with other types of hoisting devices meant for lifting loads. The hoisting device may comprise, for example, a Pneumatic Balancer/Air Balancer), Bridge Crane or, if electrical, also an Electric Overhead Travelling crane, a gantry crane such as Gantry Crane, Rail Mounted Gantry Crane, RMG or Rubber Tired Gantry Crane, RTG, Tower Crane, Slewing Jib Crane or another hoisting device known per se to which a load may be manually fastened.

Figure 2A:
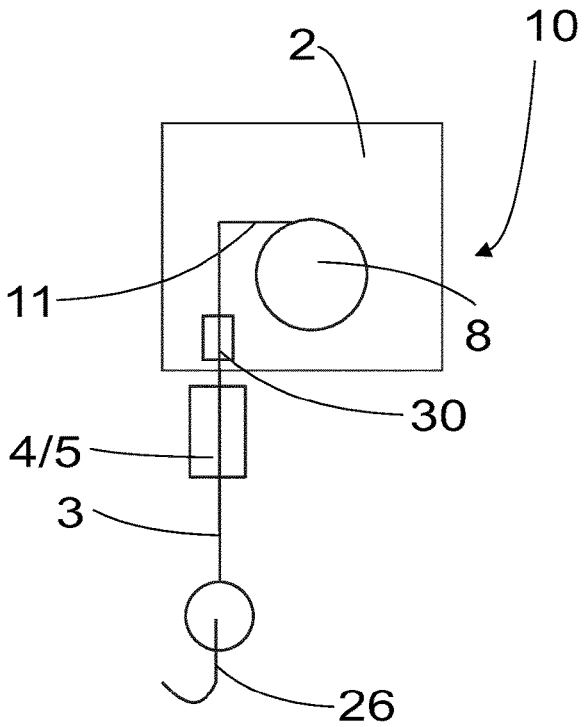
FIGS. 2*a* and 2*b* are schematic views of devices in connection with a hoisting rope of a hoisting device in a first operating position.

FIG. 2*a* is a schematic view of an embodiment of the device 10 in connection with a hoisting rope of a hoisting device in a first operating position. The device may comprise a main suspension element 11 to suspend the sheave 5 or wedge socket 4 supporting the hoisting rope 3 to a fastening structure 8 of the body 2 of the hoisting device. The device may be used, for example, in the control of the vertical movement of the hoisting rope. The device may further comprise means 30 for detecting an external vertical force acting on the hoisting rope. The external vertical force acting on the hoisting rope may in this case be detectable by the means 30 for detecting the external vertical force applied on the hoisting rope. The device may be used, for example, in the control of the vertical movement of the hoisting rope.

In an embodiment, the means for 30 for detecting an external vertical force applied on the hoisting rope may comprise a detector. The detector may be adapted to detect an external vertical force of a magnitude between 5 N and 100 N, advantageously between 10 N and 30 N, applied on the hoisting rope.

In an embodiment, the detector may comprise at least one of the following: a strain gauge, force sensor, distance sensor, and pressure sensor. The sensor may be adapted in connection with, for example, the hoisting rope 3, sheave 5. wedge socket 4, or fastening structure 8 of the body 2 of the hoisting device, or a joint between any of these structural parts.

In an embodiment, the sensor may comprise a pneumatic or hydraulic bellows and a pressure sensor measuring the pressure of the bellows. Such a bellows may be adapted in connection with, for example, the hoisting rope 3, sheave 5. wedge pocket 4, or fastening structure 8 of the body 2 of the hoisting device, or a joint between these structural parts so that the pressure within the bellows changes when an external vertical force is caused to act on the hoisting rope 3. An external vertical force acting on the hoisting rope may be detected on the basis of a change in the internal pressure within the bellows, detected with the pressure sensor.

Figure 2B:
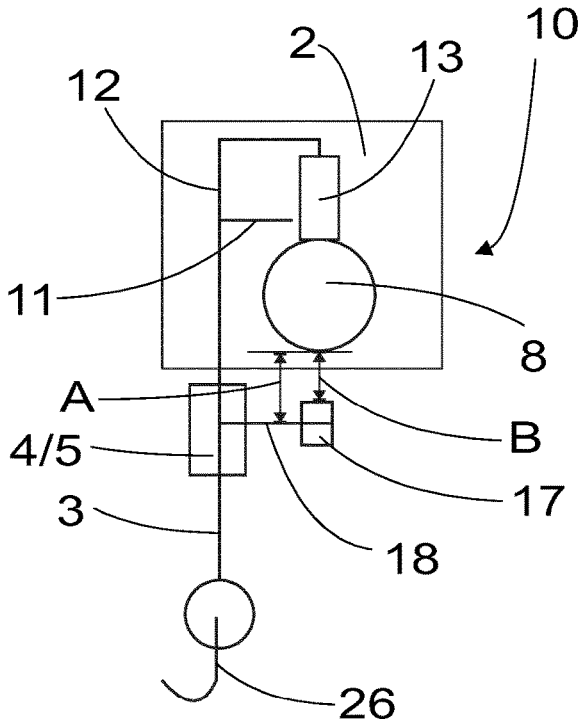

FIG. 2*b* is a schematic view of an embodiment of the device 10 in connection with a hoisting rope of a hoisting device in a first operating position. The device may comprise a main suspension element 11 to suspend the sheave 5 or wedge socket 4 supporting the hoisting rope 3 to a fastening structure 8 of the body 2 of the hoisting device. The device may be used, for example, in the control of the vertical movement of the hoisting rope.

Figure 3:
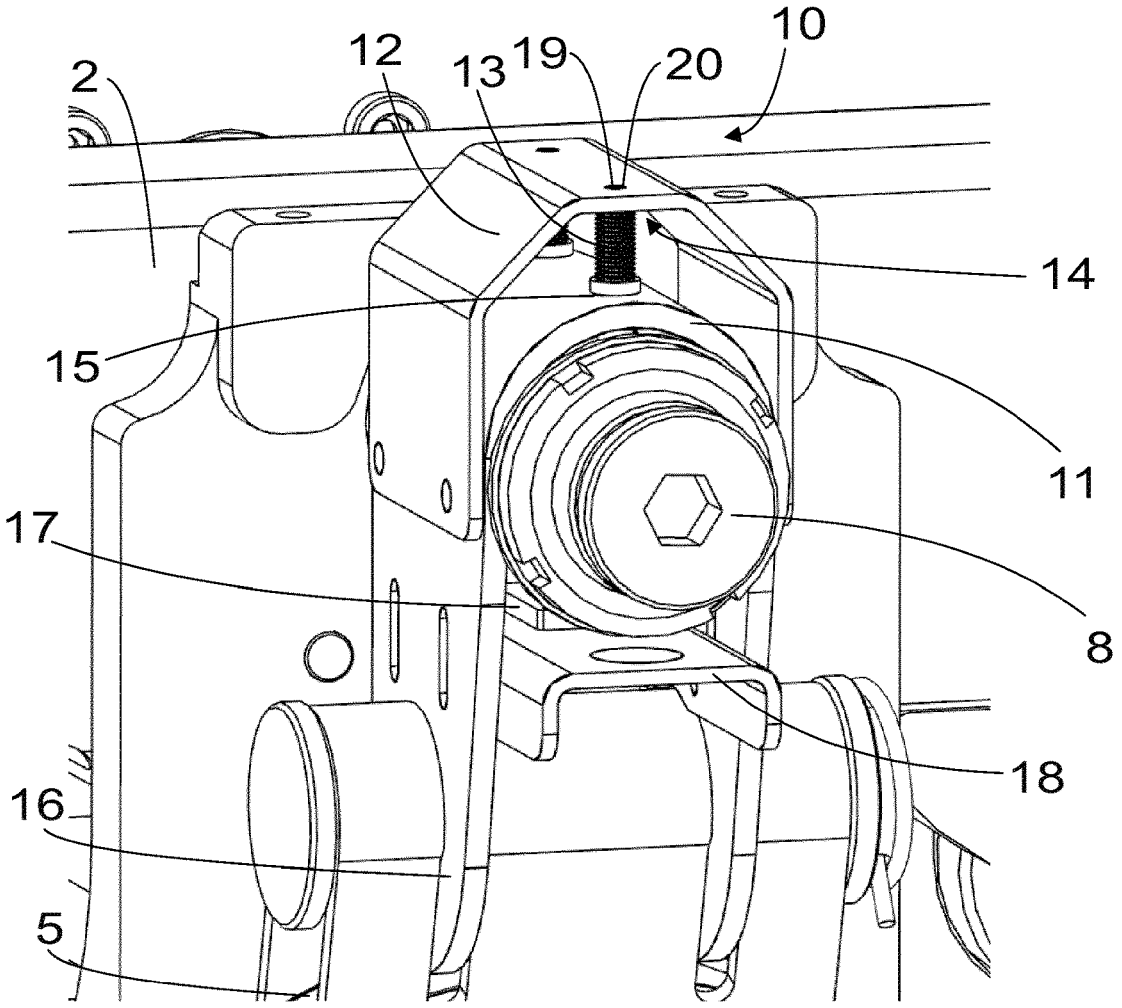
FIG. 3 is a schematic views of a device according to an embodiment in connection with a hoisting rope of a hoisting device in a first operating position.
Figure 4:
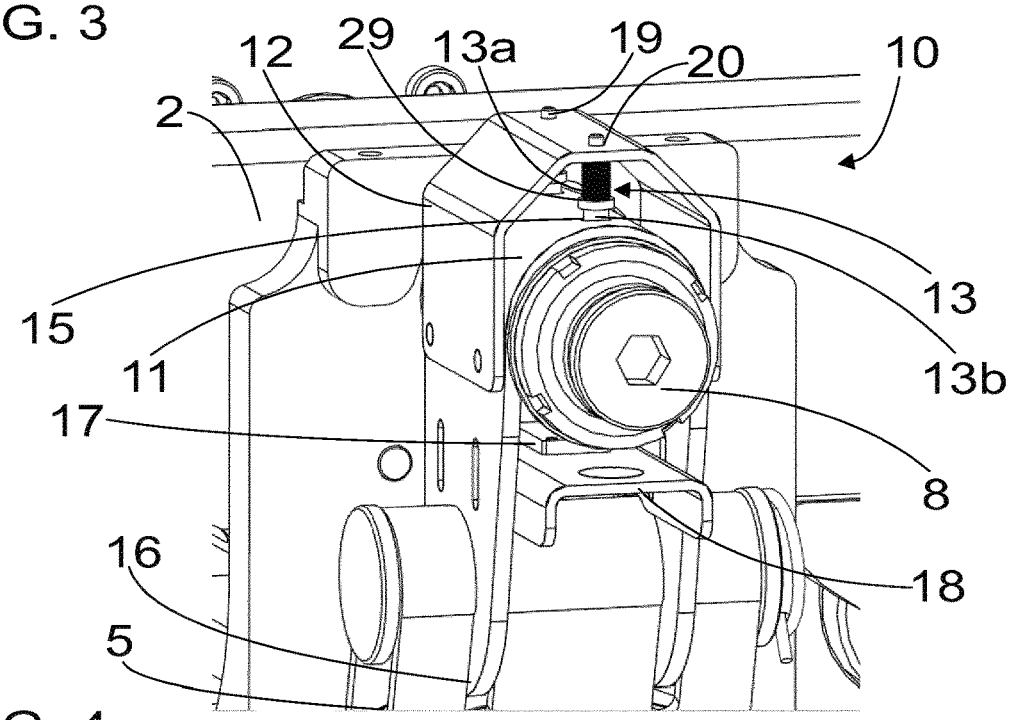
FIG. 4 shows the device of FIG. 3 in a second operating position.
Figure 5:
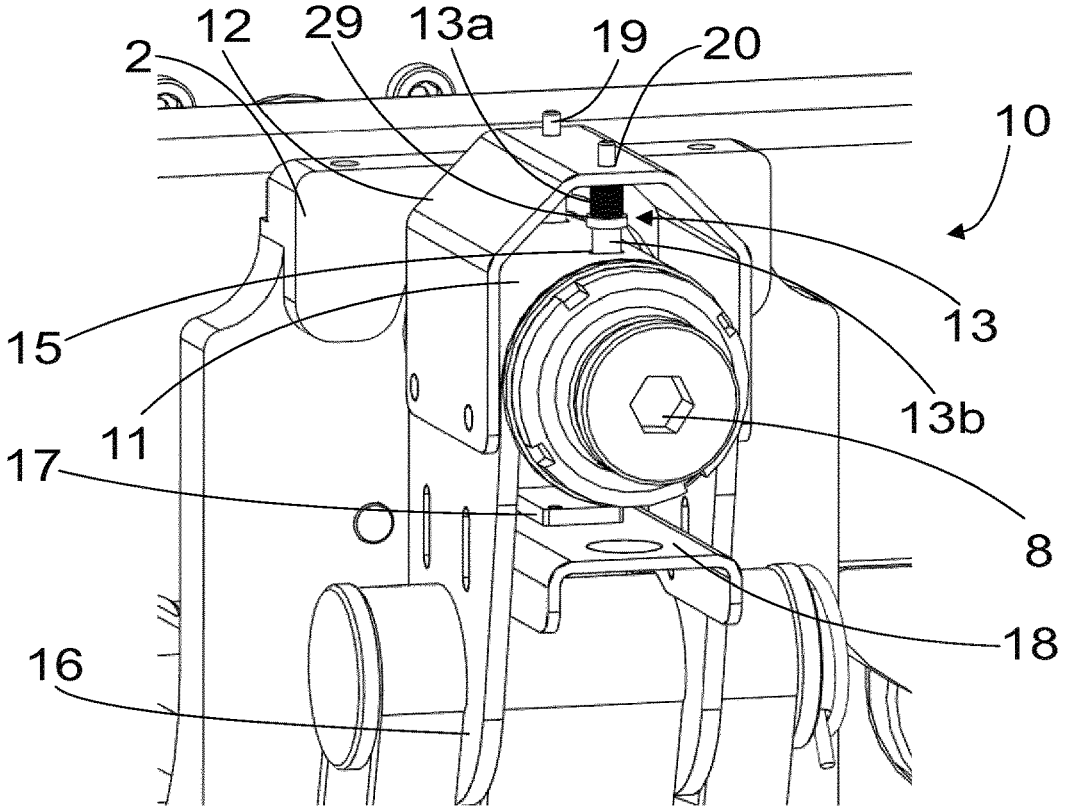
FIG. 5 shows the device of FIG. 3 in a third operating position.

The device 10 may further comprise an auxiliary suspension element 12. Depending on the embodiment, the auxiliary suspension element 12 may be arranged fixedly in the main suspension element 11, as shown in the embodiment of FIGS. 3 to 5, or the auxiliary suspension element 12 may be arranged in the device 10 movably in relation to the main suspension element 11. Arranging fixedly refers to adapting the structural parts to each other in a substantially immovable manner.

The auxiliary suspension element 12 may be attached in relation to the sheave 5 or wedge socket 4 so that the movement at any time of the sheave or wedge socket is transmitted to the auxiliary suspension element. The auxiliary suspension element 12 may be attached in relation to the sheave 5 or wedge socket 4 in a substantially immovable way, for example. In other words, substantially immovable here refers to such a joining where the movement of the sheave or wedge socket is transmitted to the auxiliary suspension element. The auxiliary suspension element 12 may in an embodiment also be attached flexibly in relation to the sheave 5 or wedge socket 4, as long as the movement at any time of the sheave or wedge socket is transmitted to the auxiliary suspension element. The auxiliary suspension element 12 may be directly attached to the sheave 5 or wedge socket 4 or through the main suspension element 11 an/or specific fastening means 16. These fastening means 16 may form a separate part installed in the main suspension element 11 or the auxiliary suspension element 12, or they may form a uniform structural part with the main suspension element 11 and/or the auxiliary suspension element 12, that is, a uniform part of the main suspension element 11 and/or auxiliary suspension element 11.

In an embodiment, such as embodiments similar to those in FIGS. 3 to 5, the auxiliary suspension element 12 may be attached to the sheave 5 or wedge socket 4 through the main suspension element 11 and/or fastening means 16. In other words, the auxiliary suspension element 12 may be substantially immovably attached to the main suspension element 11 either as a separate structural part or a uniform structure. The main suspension element 11, for its part, may be attached to the sheave 5 or wedge socket 4 either directly or through the fastening means 16 in such a manner that the movement of the sheave or wedge socket is transmitted to the main suspension element, for instance substantially immovably. These fastening means 16 may form a separate part installed in the main suspension element 11, or they may form a uniform structural part with the main suspension element 12, that is, a uniform part of the main suspension element 12. The fastening means 16 may comprise, for example, a fastening clamp of the sheave, or a fastening point for the wedge socket. In such embodiments, the movement of the sheave 5 or wedge socket 4 may at any one time thus be transmitted to the auxiliary suspension element 12 through the main suspension element 11 and/or fastening means 16.

The device 10 may further comprise at least one element 13 flexible in at least its longitudinal direction. The flexible element 13 may be adapted to extend between the auxiliary suspension element 12 and the fastening structure 8 of the body of the hoisting device. Depending on the embodiment, the flexible element 13 may be arranged fixedly to the fastening structure 8 of the body, or the flexible element 13 may be adapted in a direct or indirect contact with the fastening structure 8 of the body, as a separate structural part of the body of the fastening structure 8 and detachable from it. The flexible element 13 may further be adapted in a direct or indirect contact with the auxiliary suspension element 12 and the fastening structure 8 of the body of the hoisting device so that the spring force of the flexible element 13 acts on both the auxiliary suspension element 12 and the fastening structure 8 of the body of the hoisting device. The longitudinal direction of the flexible element 13 in this context refers to the direction that extends from the fastening structure 8 towards the auxiliary suspension element 12. Indirect contact refers to the fact that the flexible element 13 need not be in direct contact with the fastening structure 8 of the body and/or the auxiliary suspension element 12, but the contact may be realised through an intermediate piece, such as a separate structural part.

In an embodiment, the flexible element 13 may at least in its longitudinal direction be flexible along the entire length of the flexible element 13. In a second embodiment, the flexible element 13 may comprise a part flexible in at least in its longitudinal direction and a part inflexible in at least its longitudinal direction. The part flexible in its longitudinal direction and the part inflexible in its longitudinal direction in the flexible element 13 may in different embodiments be adapted successively, or at least partly within each other, in the longitudinal direction of the flexible element 13. In the embodiment of FIGS. 3 to 5, the part flexible in its longitudinal direction and the part inflexible in its longitudinal direction in the flexible element 13 are adapted partly within each other, as will be explained in more detail in connection with the description of the Figures in question.

The flexibility of the flexible element 13 may in different embodiments be achieved with the material, structure, or their combination, of the flexible element 13 or a part thereof. In other words, the flexible element 13 may at least partly be formed of a flexible material and/or the structure of the flexible element 13 may be formed to be flexible at least in the longitudinal direction. In an embodiment, the flexible element 13 may comprise a spring, such as a coil spring or a gas spring, or another spring suitable for the purpose of use, or a structural part formed of material flexible in at least its longitudinal direction. In an embodiment, the device 10 may comprise two or more flexible elements.

The device 10 may further comprise detection means 17 to detect the distance A, or a change in it, between the suspendable sheave 5 or wedge socket 4 and the fastening structure 8 of the body of the hoisting device 2. These detection means 17 may in such a case form the means 30 for detecting an external vertical force applied on the hoisting rope, or part of the means 30 for detecting an external vertical force applied on the hoisting rope. In an embodiment, the detection means 17 may be adapted to detect the distance A, or a change in it, between the sheave 5 or wedge socket 4 and the fastening structure 8 of the body 2 of the hoisting device directly. In a second embodiment, such as the embodiment of FIGS. 3 to 5, the detection means 17 may be adapted to detect a distance B which correlates with the distance, or a change in it, between the sheave 5 or wedge socket 4 and the fastening structure 8 of the body 2 of the hoisting device, such as part of the distance in question, for example In this case, the device 10 may further comprise, for example, a mounting structure 18 which is arranged substantially immovably in the fastening means 16, or as part of the fastening means 16, and the detection means 17 may have been arranged fixedly in this mounting structure 18. In different embodiments, the mounting structure 1, detection means 17 and/or their components may, on the other hand, be adapted in other structural parts of the device 10 and/or hoisting device 1 as long as the detection means 17 may be adapted to detect the distance, or a change in it, between the sheave 5 or wedge socket 4 and the fastening structure 8 of the body 2 of the hoisting device. In an embodiment, a first component of the detection means may be adapted, for example, in a structural part immovable in relation to the hoisting device body 2, and a second component may be adapted in a structural part which is adapted to move with the sheave 5 or wedge socket 4, either directly or through the mounting structure 18. The mounting structure 18 may comprise, for example, a plate-like or beam-like structure to which the detection means 17 may be fixedly arranged.

In an embodiment, the detection means 17 may comprise a sensor, such as a distance sensor. In an embodiment, the distance sensor may comprise at least one of the following: an inductive distance sensor, ultrasonic sensor, capacitive sensor, magnetic inductive sensor, cable pull sensor, Hall sensor, optical distance sensor, pressure sensor, sensor based on a conductor, laser measurement, and microswitch arrangement. Such detection means of a distance and its changes, and their operating principles are known per se to a person skilled in the art, for which reason they are not described in this context in any more detail. In a solution described in this specification, such as in a disclosed device 10, arrangement, or method, the flexible element 13 displaceable by directing an external vertical force at the hoisting rope 3. In this context, external vertical force refers to a force that is caused as a result of acting on, for example, a hoisting rope 3 manually, for example, that is, when an operator displaces the hoisting rope 3 or load fastening means 26 adapted on it in the vertical direction, or as a result of an external load adapted on the hoisting rope or load fastening means adapted thereto. In other words, external force does not refer to, for example, the forces created by the structural parts of the hoisting device 1 or device 10. Because the length of the flexible element 13 changes when the flexible element 13 is displaced by applying an external vertical force on the hoisting rope 3, the vertical force applied on the hoisting rope 3 may be detected on the basis of the distance, or a change therein, between the sheave 5 or wedge socket 4 and the fastening structure 8 of the body 2 of the hoisting device.

In other words, the device 10, when no external force is acting on it, is in a state which in this specification is referred to as a neutral position. In this neutral position, the flexible element 13, or to be more precise, the length of the flexible element in the longitudinal direction of the flexible element, is at its neutral position or neutral length, and the sheave 5 or wedge socket 4 and the fastening structure 8, main suspension element 11 and auxiliary suspension element 12 are in their neutral positions in relation to each other.

When the hoisting rope 3 is displaced by lightening upward, so by affecting the hoisting rope in the hoisting direction, manually or by manpower, the force pulling the hoisting rope or the load fastening means 26, such as a hook, sheave 5 or wedge socket 4 adapted on it, is reduced, that is, the load that the flexible element 13 is bearing becomes lesser. This change in the force may be adapted, depending on the embodiment, to displace the flexible element 13 so that the length of the flexible element 13 in the longitudinal direction of the flexible element increases or decreases.

In an embodiment, such as the embodiment in FIGS. 3 to 5, the weight of the hoisting rope 3 and potential weight 25 compresses the flexible element 13 adapted on the opposite side of the fastening structure 8 of the body of the hoisting device in relation to the sheave 5 or wedge socket 4. When no load is adapted on the hoisting rope 3, displacing the hoisting rope 3 upward and consequently lightening the load that the flexible element 13 is bearing, causes an increase in the length of the flexible element 13. In such a case, the flexible element 13 may be adapted to push the auxiliary suspension element 12 away from the fastening structure 8, so upward in FIGS. 3 to 5, as the hoisting rope 3 or load fastening means 26 adapted on it is displaced upward. In this case, also the distance between the sheave 5 or wedge socket 4 and the fastening structure 8 shortens correspondingly, which may be detected by the detection means 17. FIG. 3 shows a device 10 according to an embodiment in such a state, that is, in a so-called first operating position.

Figure 6:
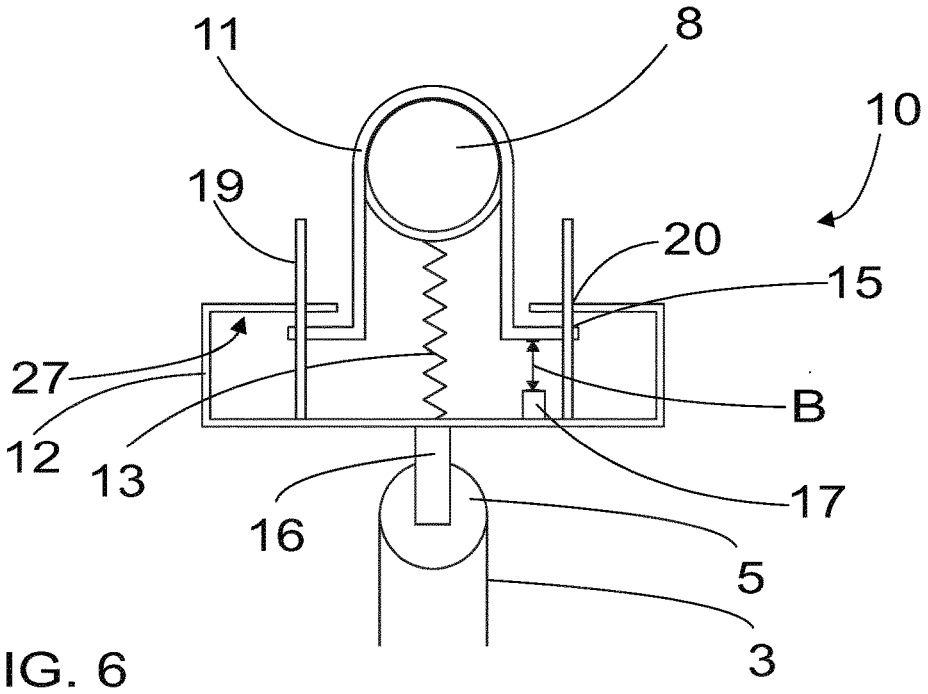
FIG. 6 is a schematic views of a device according to a second embodiment in connection with a hoisting rope of a hoisting device in a first operating position.

In a second embodiment, such as the embodiment of FIG. 6, the flexible element 13 is adapted on the same side as the sheave 5 or wedge socket 4 in relation to the fastening structure 8 of the body. In such a case, the weight of the hoisting rope 3 and potential load 25 pulls the flexible element 13 longer. When no load is adapted on the hoisting rope 3, displacing the hoisting rope 3 upward and consequently lightening the load that the flexible element 13 is bearing, causes a decrease in the length of the flexible element 13. In such a case, the flexible element 13 may be adapted to pull the auxiliary suspension element 12 towards the fastening structure 8, so upward in FIG. 6, as the hoisting rope 3 or load fastening means 26 is adapted on it is displaced upward. In this case, also the distance between the sheave 5 or wedge socket 4 and the fastening structure 8 shortens correspondingly, which may be detected by the detection means 17. FIG. 6 shows a device 10 according to an embodiment in such a state, that is, in a so-called first operating position.

When the hoisting rope 3 is displaced downward by pulling manually or by manpower, the force pulling down the hoisting rope or the load fastening means 26, such as a hook, sheave 5 or wedge socket 4 adapted on it, is increased, that is, the load that the flexible element 13 is bearing grows. This change in the force may be adapted to displace the flexible element 13 in the opposite direction compared to the lightening, or reduction, of the downward-pulling force. In other words, in an embodiment such as the embodiment of FIGS. 3 to 5, the length of the flexible element 13 in the longitudinal direction of the longitudinal element may shorten, so the flexible element 13 may be compressed more. The flexible element 13 may in such a case be adapted to allow the auxiliary suspension element 12 closer to the fastening structure 8, so downward in FIGS. 3 to 5. Correspondingly in a second embodiment such as the embodiment of FIG. 6, the flexible element 13 may stretch more, so the length of the flexible element in the longitudinal direction of the longitudinal element may increase as the load the flexible element 13 is bearing increases. In this case, in both the embodiments described, as well as in the embodiment of FIGS. 3 to 5 and the embodiment of FIG. 6, also the distance between the sheave 5 or wedge socket 4 and the fastening structure 8 increases by a corresponding amount, which may be detected by the detection means 17. FIG. 4 shows a device 10 of FIG. 3 in such a state, that is, in a so-called second operating position.

When a load is fastened to the hoisting rope 3 or load fastening means 26, such as a hook, adapted thereto, the force pulling the sheave 5 or wedge socket 4 downward may increase considerably compared to the force by which the hoisting rope is manually acted on, in other words, the hoisting rope 3 is lifted or pulled by manpower. So, the load the flexible element 13 is bearing increases both when compared to the neutral position and the situation in which the hoisting rope 3 is acted on, in particular pulled downward by manpower. This change in the force may be adapted to displace the flexible element 13 to such an extent that the load 25 shifts from being supported by the flexible element 13 to being supported by the main suspension element 11. In other words, the main suspension element 11, auxiliary suspension element 12, and the fastening structure 8 may be adapted in relation to each other so that as the load that the flexible element 13 is bearing increases larger than a predetermined value, the main suspension element 11 meets the fastening structure 8 and/or auxiliary suspension element 12 so that the main suspension element bears the load. This way, it is possible to prevent the flexible element 13 from stretching or compressing too much and its breaking.

In an embodiment, such as the embodiment shown in FIGS. 3 to 5, the shifting of the load to be supported by the main suspension element 11 instead of the flexible element 13 may be so implemented that the compressed length of the flexible element 13 is no longer enough to support the auxiliary suspension element 12 and the main suspension element 11. In such a case, the main suspension element 11 may be adapted to press against the fastening structure 8 whereby the sheave 5 or wedge socket 4, and consequently hoisting rope 3 and the load fastened to it, are adapted to be supported by the main suspension element 11. The length of the flexible element 13 is thus at its shortest, and the distance between the sheave 5 or wedge socket 4 and the fastening structure 8 is correspondingly longer than when the hoisting rope is manually lifted or pulled downward, which may be detected by the detection means 17. FIG. 5 shows a device 10 of FIG. 3 in such a state, that is, in a so-called third operating position.

In a second embodiment, such as the embodiment shown in FIG. 6, the shifting of the load to be supported by the main suspension element 11 instead of the flexible element 13 may be so implemented that as the flexible element 13 has stretched, so the length of the flexible element 13 has increased by a predetermined maximum amount, a support surface 27 of the auxiliary suspension element 12 is pressed against a mating surface 28 on the main suspension element. In such a case, the main suspension element 11 may be adapted to support the auxiliary suspension element 12 whereby the sheave 5 or wedge socket 4, and consequently hoisting rope 3 and the load fastened to it, are adapted to be supported by the main suspension element 11. The length of the flexible element 13 is thus at its longest, and the distance between the sheave 5 or wedge socket 4 and the fastening structure 8 is correspondingly longer than when the hoisting rope is manually lifted or pulled downward, which may be detected by the detection means 17.

In an embodiment, the elastic constant of the flexible element 13 may have been chosen so that an external vertical force of the magnitude of 5 N, advantageously 10 N, applied on the hoisting rope is enough to displace, so depending on the embodiment as described to stretch or compress, the flexible element 13 so that the detection means detect a change in the distance between the sheave or wedge socket and the hoisting device body, caused by the change in length of the flexible element 13, but that an external vertical force of the magnitude of 100 N, advantageously 30 N, targeted at the hoisting rope is not enough to displace the flexible element into its compressed extreme position. Extreme position of the flexible element 13 in this context refers to a state of the flexible element 13, in which an external vertical force applied on the hoisting rope displaces the flexible element 13 to such an extent that the sheave 5 or wedge socket 4, and consequently the hoisting rope 3 and the load fastened to it, are adapted to shift to be entirely supported by the main suspension element 11. In other words, the flexible element 13 may be so designed that the hoisting rope may be manually, so by an operator without any aids or special strength, displaced both in the hoisting and pulling direction to such an extent that the detection means 17 can detect it. On the other hand, the flexible element 13 may be designed so that compressing the flexible element 13 into its shortest position, which may be adapted to correspond to fastening a load to the hoisting rope 3, cannot be manually established, or cannot be established by the hoisting device operator with one hand without any special strength or aids.

As mentioned, FIG. 3 is a schematic view of a device 10 according to an embodiment in connection with a hoisting rope of a hoisting device in a first operating position. To be more specific, FIG. 3 shows an embodiment of such a device 10. In other respects than those disclosed in connection with FIG. 3, the device 10 may correspond to the other embodiments described in this specification. It is also worthwhile to note that although the device 10 is in the embodiment of FIGS. 3 to 5 shown in connection with the suspension of the sheave 5, in particular an upper sheave, and the fastening structure 8 comprises a suspension axle of the sheave, the device 10 may correspondingly be adapted to be supported by the wedge socket 4 of the hoisting device 1. The main suspension element 11 may then be adapted to the sheave 5 or wedge socket 4 either directly or indirectly, and on the other hand be arranged movably in the fastening structure 8 in such a manner that the movement of the sheave 5 or wedge socket 4 is transmitted to the main suspension element 11, for instance substantially immovably.

In an embodiment, such as the embodiment of FIGS. 3 to 5, the auxiliary suspension element 12 may be arranged fixedly in relation to the main suspension element and on the opposite side or the main suspension element 11 in relation to the suspendable sheave 5 or wedge socket 4 such that at least part of the auxiliary suspension element 12 is arranged at a distance from the main suspension element 11. The auxiliary suspension element 12 may in such a case support in the neutral position the main suspension element 11 by means of the flexible element 13. To be more precise, the flexible element may comprise a part flexible in at least in its longitudinal direction, and a part inflexible in at least its longitudinal direction, as described in the above.

In an embodiment such as the embodiment of FIGS. 3 to 5, the part inflexible in the longitudinal direction in the flexible element 13 may comprise a support pin 13*b*. The support pin 13*b* may comprise in its longitudinal direction, which is parallel to the longitudinal direction of the flexible element 13, a shoulder 29. The part flexible in its longitudinal direction in the flexible element may in this case be formed, for example, spiral-like or circular as regards its cross section so that the support pin 13*b* may be adapted within the part at least partly flexible in its longitudinal direction so that the part flexible in its longitudinal direction rests at one end thereof on the shoulder 29. The support pin 13*b* may in this case be adapted at one end, more specifically at the end to which a part flexible in its longitudinal direction has not been adapted, to rest against the fastening structure 8. In other words, the flexible element 13 may be adapted to extend between the auxiliary suspension element 12 and the fastening structure 8 so that the part 13*a* flexible in its longitudinal direction in the flexible element, comprises a surface that is adapted by the effect of the tension of the flexible element into contact with the surface 14 of the auxiliary suspension element 12, on the main suspension element side. In other words, the spring force of the flexible element acts on both the auxiliary suspension element and the fastening structure of the body of the hoisting device. The main suspension element 11 may further comprise a first opening 15 through which the flexible element 13 may be adapted to extend. The longitudinal direction of the flexible element 13 in this context refers to the direction that extends from the fastening structure 8 through the first opening 15 and towards the auxiliary suspension element 12.

In an embodiment, such as the embodiment of FIGS. 3 to 5, at least one flexible element 13 may comprise, at its end opposite the end in contact with the fastening structure 8, at least one control member 19 and the auxiliary suspension element 12 comprises a control opening 20 to control the movement of the auxiliary suspension element 12. In an embodiment, the control member 19 may in this case comprise an end of the part 13*b* of the flexible element 13, inflexible in its longitudinal direction, that is, the control member 19 may be formed as a uniform part of the flexible element 13 whereby the flexible element 13 forms the control member. In a second embodiment, the control member 19 may comprise a separate piece adapted in the flexible element 13. In a third embodiment, the control member 19 may be a separate structural part independent of the flexible element 13.

The control member 19 may be at least partly adapted in the control opening 20. The control member 19 may in such a case control the direction of movement of the auxiliary suspension element 12 in relation to the fastening structure 8, caused by the changes in the length of the part 13*a* flexible in its longitudinal direction in the flexible element 13. This prevents the movement of the auxiliary suspension element 12 in an undesired direction, that is, other than the longitudinal direction of the flexible element in relation to the fastening structure 8, and improves the measurement accuracy of the changes in the distance detected by the detection means 17.

In an embodiment, such as the embodiment of FIGS. 3 to 5, the part 13*a* of the flexible element 13, flexible in at least in its longitudinal direction, may extend between the auxiliary suspension element 12 and shoulder 29, and the inflexible part 13*b* may extend from the fastening structure 8 towards the auxiliary suspension element 12 through the first opening 15 of the main suspension element 11 and through the control opening 20 of the auxiliary suspension element. In a second embodiment, which may in other respects correspond with the embodiments disclosed in this specification, such as the embodiment of FIGS. 3 to 5, the flexible element 13 may be flexible in at least its longitudinal direction for its entire length. The flexible element 13 may in this case be adapted to extend through the first opening 15, for example. Such an embodiment may also comprise the control opening 20 of the auxiliary suspension element, or the flexible element 13 may be adapted at one end, for example, into contact with the surface of the auxiliary suspension element 12, which is directed towards the fastening structure 8.

FIG. 6 is a schematic views of a device according to a second embodiment in connection with a hoisting rope of a hoisting device in a first operating position. In other respects than those disclosed in connection with FIG. 6, the device 10 may correspond to the other embodiments described in this specification, such as those disclosed in connection with FIGS. 2 to 5. It is also worthwhile to note that although the device 10 is in the embodiment of FIG. 6 shown in connection with the suspension of the sheave 5, in particular an upper sheave, and the fastening structure 8 comprises a suspension axle of the sheave, the device 10 may correspondingly be adapted to be supported by the wedge socket 4 of the hoisting device 1. The auxiliary suspension element 12 may in this case be arranged substantially immovably to the sheave 5 or wedge socket 4 directly or indirectly, and on the other hand be movably adapted in relation to the fastening structure 8.

Contrary to the embodiments of FIGS. 3 to 5, for example, the main suspension element 11 may in the embodiment of FIG. 6 be adapted into contact with the fastening structure 8 in all the operating positions of the device 10, such as the neutral operating position, first operating position, second operating position, and third operating position. In other words, the main support element 11 may be arranged to be supported by the fastening structure 8, advantageously substantially immovably in relation to the fastening structure 8.

In an embodiment, such as the embodiment of FIG. 6, the auxiliary suspension element 12 may be arranged movably in relation to the main suspension element 11 and on the same side of the main suspension element 11 in relation to the suspendable sheave 5 or wedge socket 4, in other words the auxiliary suspension element 12 and the sheave or wedge socket may have been adapted on the same side in relation to the main suspension element 11 and fastening structure 8. The sheave or wedge socket may in this case be arranged substantially immovably in relation to the auxiliary suspension element 12 either directly or indirectly. In other words, the sheave or wedge socket may be arranged substantially immovably to the auxiliary suspension element directly with a joining method known per se, or indirectly through a separate structural part.

In an embodiment, such as in the embodiment of FIG. 6, the flexible element 13 may be flexible in at least in its longitudinal direction substantially along its entire length, or it may comprise a part 13*a* flexible in its longitudinal direction and a part 13*b* inflexible in its longitudinal direction. The flexible part 13*a* and the inflexible part 13*b* may in this case be adapted successively in relation to each other in the longitudinal direction of the flexible element 13, or at least partly within each other, or by another appropriate manner.

In an embodiment, such as in the embodiment of FIG. 6, the flexible element 13 may be arranged at one of its ends substantially immovably to the fastening structure 8 directly or indirectly. In other words, the first end of the flexible element may be arranged fixedly with a joining method known per se to the fastening structure 8 or to a structural part arranged substantially immovably to the fastening structure 8, such as the main suspension element 11 or a separate structural part. The second end of the flexible element 13, so the opposite end in relation to the first end in the longitudinal direction of the flexible element, may be arranged substantially immovably to the auxiliary suspension element 12 directly or indirectly. In other words, the flexible element may be adapted to extend between the auxiliary suspension element 12 and the fastening structure 8 or a structural part arranged immovably to the fastening structure 8. The auxiliary suspension element 12 may in such a case be adapted to support in the neutral position the sheave 5 or wedge socket 4 by means of the flexible element 13. More specifically, the flexible element 13 may in an embodiment of this kind support the auxiliary suspension element 12 and, through it, the sheave 5 or wedge socket 4 adapted to the auxiliary suspension element 12 in the neutral position both in the first and second operating position. In such a case, the spring force of the flexible element 13 acts on both the auxiliary suspension element 12 and the fastening structure 8 of the body of the hoisting device. In an embodiment, such as the one of FIG. 6, the flexible element 13 may comprise a spring, for example, or a structural part formed of material flexible in at least its longitudinal direction.

In an embodiment, such as the one of FIG. 6, the main suspension element 11 may comprise a mating surface 28 against which the support surface 27 of the auxiliary suspension element 12 may press when the force applied on the hoisting rope 3 and, through it, to the sheave 5 and/or wedge socket 4 increases high enough. In other words, in such a case the force applied on the hoisting rope 3 displaces the flexible element 13 to such an extent that the auxiliary suspension element 12 moves to the direction of the sheave 5 or wedge socket 4 in relation to the neutral position, a distance that corresponds to the distance between the support surface 27 and mating surface 28 in the neutral position, so the support surface 27 and mating surface 28 settle against each other. Advantageously, this takes place in the third operating position of the device 10, in other words when a load 25 has been adapted to the hoisting rope 3. The mating surface 28 may be adapted at the end of the main suspension element 11, on the side of the sheave 5 or wedge socket 4, to a horizontal flange of the main suspension element 11, for example. Advantageously, the horizontal flange of the main suspension element may extend away from the flexible element 13, that is, outward. The support surface 27 may be formed in the horizontal flange of the auxiliary suspension element 12. Advantageously, the horizontal flange of the auxiliary suspension element may extend towards the flexible element 13 and main suspension element 11.

In an embodiment, such as the one of FIG. 6, the auxiliary suspension element 12 may be arranged movably together with the sheave 5 or wedge socket 4 in relation to the main suspension element 11 which is arranged substantially immovably in relation to the fastening structure 8. In such a case, the detection means 17 may be adapted to detect the distance, or a change in the distance, between the auxiliary suspension element 12 and the main suspension element 11, for example, because a change in this distance naturally correlates with the change in distance between the fastening structure 8 and sheave 5 or wedge socket 4 The detection means 17 may in such a case be adapted to the main suspension element 11 and/or auxiliary suspension element 12, for example, in a manner known per se, so that the detection means 17 are adapted to measure the distance between the auxiliary suspension element 12 and main suspension element 11 and/or a change in the distance.

The device 10 may further comprise at least one control member 19, in the embodiment of FIG. 6 two control members 19, to control the movement of the auxiliary suspension element 12. The control member 19 may comprise a longitudinal structure, for example. The main suspension element 11 may comprise a first opening 15 and/or the auxiliary suspension element 12 may comprise at least one control opening 20 per each control member 19, whereby the control member 19 may be adapted to pass at least partly through the first opening 15 and/or the second opening to control the movement of the auxiliary suspension element 12. Each control member 19 may be arranged immovably to the main suspension element 11, auxiliary suspension element 12, or another structural part of the hoisting device 1 in such a manner that the control member 19 may control the direction of movement of the auxiliary suspension element 12 in relation to the fastening structure 8, caused by the changes in the length of the part 13*a* of the flexible element 13, flexible in its longitudinal direction.

In an embodiment, the means for 30 for detecting an external vertical force applied on the hoisting rope comprise a detector. In an embodiment, this detector comprises at least one of the following: a strain gauge, force sensor, distance sensor, pressure sensor, inductive distance sensor, ultrasonic sensor, capacitive sensor, magnetic inductive sensor, cable pull sensor, Hall sensor, optical distance sensor, sensor based on a conductor, laser measurement, and microswitch arrangement. Ina n embodiment, the detector may be adapted to detect an external vertical force of a magnitude advantageously between 5 N and 100 N, most advantageously between 10 N and 30 N, applied on the hoisting rope. In an embodiment, at least one of the following is used as the distance sensor: an inductive distance sensor, ultrasonic sensor, capacitive sensor, magnetic inductive sensor, cable pull sensor, Hall sensor, optical distance sensor, pressure sensor, sensor based on a conductor, laser measurement, and microswitch arrangement. In an embodiment, the detection means 17 comprise a sensor, such as any one of those set forth in the above. In an embodiment, the detector, for example a distance detector, such as one of the above distance sensors, may be adapted to detect the distance between the sheave or wedge socket and the fastening structure of the hoisting device body, or a change in the distance.

It is obvious for a person skilled in the art that the figures only show some of the embodiments of the solution, and the main suspension element and auxiliary suspension element, for example, may depending on the embodiment substantially differ in their design and structure from the embodiments of FIGS. 2*a* to 6 and the associated description, as long as they operate in the manner set forth and are functionally suitable for the described purpose.

Figure 7:
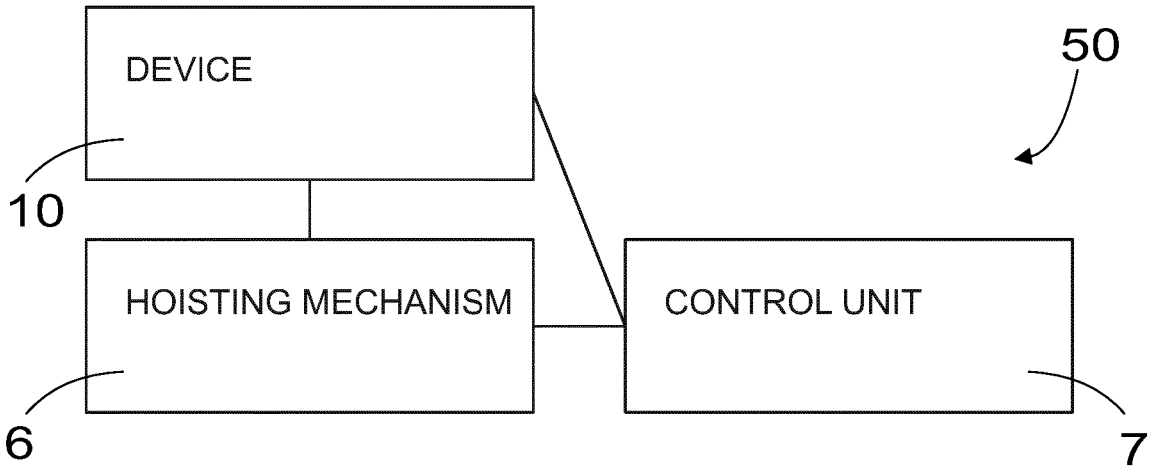
FIG. 7 is a schematic view of an arrangement in connection with a hoisting rope of a hoisting device.

FIG. 7 is a schematic view of an arrangement 50 in connection with a hoisting rope of a hoisting device. Such an arrangement 50 may be used to control the vertical movement of a hoisting rope 3 of a hoisting device 1, that is, this may concern an arrangement for controlling the vertical movement of the hoisting rope 3 or the hoisting device 1. The arrangement 50 may comprise any one of the devices 10 set forth in this specification. Such a device may be utilized in the detection of an external vertical force applied on the hoisting rope 3. The arrangement 50 may also comprise a hoisting mechanism 6 for moving the hoisting rope 3. Such hoisting mechanisms 6 are known per se and are therefore not described in any more detail in this context.

The arrangement 50 may further comprise a control unit 7. The control unit 7 may be adapted to control the hoisting mechanism 6 to move the hoisting rope 3 in the vertical direction in response to at least detecting an external vertical force applied on the hoisting rope. The external vertical force applied on the hoisting rope may in this case be detected by the means 30 for detecting an external vertical force applied on the hoisting rope. In other words, with the means 30 for detecting an external vertical force applied on the hoisting rope, affecting the hoisting rope 3 either by manually lightening the hoisting rope 3 or pulling the hoisting rope 3 downward may be detected. The means for 30 for detecting an external vertical force applied on the hoisting rope may forward information on the distance or changes in it to the control unit 7. The control unit 7 may be adapted to detect an external vertical force applied on the hoisting rope on the basis of this information and to control the hoisting mechanism 6 to move the hoisting rope 3 in the vertical direction in response to receiving this information. The means for 30 for detecting an external vertical force applied on the hoisting rope may comprise means described in connection with the device and method embodiments.

In an embodiment, the detection of an external vertical force applied on the hoisting rope may comprise detection of a change in the distance between the suspendable sheave or wedge socket and the fastening structure of the hoisting device body. In other words, an external vertical force applied on the hoisting rope may be detected on the basis of a change in the distance between the suspendable sheave 5 or wedge socket 4 and the fastening structure of the hoisting device body 2. The control unit 7 may in such a case be adapted to control the hoisting mechanism 6 to move the hoisting rope 3 in the vertical direction in response to at least detecting a change in the distance between the suspendable sheave 5 or wedge socket 4 and the fastening structure of the hoisting device body 2. This detection may be carried out at the control unit 7 on the basis of the change in distance detected by the detection means 17 and the change in distance information conveyed to the control unit. In other words, with the detection means 17, affecting the hoisting rope 3 either by manually lightening the hoisting rope 3 or pulling the hoisting rope 3 downward may be detected. The detection means 17 may forward information on the distance or changes in it to the control unit 7. The control unit 7 may be adapted to detect the affecting on the hoisting rope 3 in the vertical direction on the basis of the detected distance or change in the distance between the sheave 5 or wedge socket 4 and the fastening structure 8 of the hoisting device body 2.

The control unit 7 may further be adapted to control the hoisting mechanism 6 in response to the detected acting on the hoisting rope 3 in the vertical direction by issuing control commands and/or control signals to the hoisting mechanism 6 to control the hoisting rope in the vertical direction, so up or down. In an embodiment, the control unit 7 may be adapted to give the hoisting mechanism 6 a control command and/or control signal to lower the hoisting rope 3 down when an external force directed downward is applied on the hoisting rope, that is, the hoisting rope 3 or load fastening means 26, such as a hook, adapted on it is pulled downward. Correspondingly, the control unit 7 may be adapted to give the hoisting mechanism 6 a control command and/or control signal to lift the hoisting rope 3 up when an external force directed upward is applied on the hoisting rope, that is, the hoisting rope 3 or load fastening means 26, such as a hook, adapted on it is lifted upward. Due to the above, an operator may in other words control the hoisting mechanism 6 and through it the vertical movement of the hoisting rope 3 by affecting the hoisting rope 3 or load fastening means adapted on in, such as a hook. In other words, the operator may give the control unit 7 a control command and/or control signal through the hoisting rope 3. This makes possible an easy and exact positioning of the hoisting rope at the correct height from beside the load to be fastened. The various embodiments of the device 10 are described in connection with FIGS. 2*a* to 6, for example. For reasons of simplicity, control commands and/or control signals will from hereafter be referred to as control commands.

In an embodiment, the control unit 7 may comprise, for example, the control system of the hoisting device or the part that may be programmed to control the hoisting device in response to a detected external vertical force applied on the hoisting rope. In an embodiment, the control unit 7 may comprise a PLC (Programmable Logic Controller). In a second embodiment, the control unit 7 may comprise relay control, adapted to control the hoisting mechanism 6, such as the contactor of the hoisting motor, on the basis of signals received from the detector means 17. In yet another embodiment, the control unit 7 may comprise a frequency converter or another suitable component of the hoisting device, which may be programmed to control the hoisting device in response to a detected external vertical force acting on the hoisting rope. The control unit 7 may further comprise a memory 22 and a processor 23, which may form a processing unit 24.

In an embodiment, the arrangement 50 may comprise a remote controller 51. The remote controller 51 may provide a user interface 52, by means of which an operator may affect the remote controller 51 in order to give control commands to the control unit 7. The remote controller 51 may be connected to the control unit 7 on a wired or wireless link. A wireless connection may comprise a wireless telecommunications link, such as a wireless local area network (WLAN) connection based on the IEEE 802.11, a Bluetooth connection, or a standardized radio frequency connection or one according to the manufacturer's own protocol. The user interface 52 may comprise at least one of the following user interface means, which an operator may use to affect the remote controller 51 in order to give control commands to the control unit: a joystick, push button, touch screen, and a detector detecting control gestures.

In an embodiment, the control unit 7 may further be adapted to control the hoisting mechanism 6 to move the hoisting rope 3 in the vertical direction in response to simultaneous detection of an external vertical force applied on the hoisting rope and detection of a control command given by means of the user interface 52 of the remote controller 51. In other words, the control unit 7 may be adapted to give the hoisting mechanism 6 a control command to control the hoisting rope 3 in the vertical direction, such as lifting or lowering the hoisting rope, in response to an operator simultaneously moving the hoisting rope 3 directly or through the load fastening means 26 adapted to it, and affecting the user interface 52 of the remote controller 51 to give the control command. The remote controller 51 may comprise a separate control device, which may be adapted as a separate control device or adapted on the load fastening means 26, for example. As mentioned, the control unit 7 in such a case takes into account a control command to move the hoisting rope in the vertical direction, given by means of the hoisting rope 3, only when the remote controller 51, and its user interface 52, in particular, are acted on. This increases the safety of the arrangement 50 and the hoisting device 1, because the positioning of a load fastening means to a load, or a hoisting rope meeting an obstacle, do not erroneously trigger a control command. In an embodiment, the user interface 52 or the remote controller 51 may in such a case comprise a so-called "dead man's switch".

In an embodiment, the control unit 7 may further be adapted to determine a reference value for the distance between the suspendable sheave 5 or wedge socket 4 and the fastening structure 8 of the body 2 of the hoisting device in response to detecting a control command given with the user interface 52 of the remote controller 51. In other words, the control unit 7 may be adapted to determine the distance between the sheave 5 or wedge socket 4 and the fastening structure 8 of the body of the hoisting device 2 at the moment the operator gives a control command by means of the user interface 52 of the remote controller 51, for example, has started to act on the user interface 52, and to store this reference value in the memory of the control unit 7 as the reference value for the distance.

In another embodiment, the reference value for the distance may be fixedly determined in advance. In a third embodiment, instead of a reference value for the distance, the state of the detector 17 may, on the basis of distance, change between predefined states. In such a case, the state of the detector 17 and therefore the state it conveyed to the control unit 7 may correspond to the control commands to control the hoisting rope 3 up, to stop the movement of the hoisting rope, and to control the hoisting rope down. In this case, controlling the hoisting mechanism may thus be based on the state of the detector 17.

In an embodiment, the control unit 7 may be adapted to control the hoisting mechanism 3 to control the hoisting rope 5 to go up or down in response to the direction of the change of the distance between the suspendable sheave 5 or wedge socket 4 and the fastening structure 8 of the hoisting device body, compared to the reference value. In other words, the control unit 7 may be adapted to choose the control direction of the hoisting rope up or down, depending on the direction of the change in the distance in relation to the reference value.

In an embodiment, the control unit 7 may be adapted to define the speed of movement of the hoisting rope 3 in response to the magnitude of the change of the distance between the suspendable sheave 5 or wedge socket 4 and the fastening structure 8 of the hoisting device body, compared to the reference value. In other words, the speed of movement of the hoisting rope 3 may be controlled according to how large an external vertical force is applied on the hoisting rope. The control unit 7 may, for example, be adapted to control the speed of the hoisting rope 3 faster when a greater force is acting on it, whereby the change in the distance compared to the reference value is greater than when a lesser force is acting on the hoisting rope 3 and the change in the distance is also smaller compared to the reference value.

In an embodiment, the control unit 7 may be adapted to detect manual lightening of the hoisting rope 3 on the basis of the shortening of the distance between the sheave 5 or wedge socket 4 and the fastening structure 8 of the hoisting device body, detected by the detection means 17, compared to the neutral position where no external force is acting on the hoisting rope. Depending on the embodiment, this may be caused by the flexible element 13 compressing to a position shorter than the neutral position, as in the embodiment of FIG. 6, or stretching to a position longer than the neutral position, as in the embodiment of FIGS. 3 to 5. In other words, the direction of displacement of the flexible element 13 may depend on whether the auxiliary suspension element 12 is adapted with the sheave 5 and/or wedge socket 4 on the opposite sides or the same side in relation to the fastening structure 8. The control unit 7 may in such a case be adapted to control the hoisting mechanism 6 to lift the hoisting rope 3 in response to manual lightening of the hoisting rope. In other words, the hoisting apparatus 6 may be controller to lift the hoisting rope 3 when the hoisting rope 3 is manually lightened, such as lifted, whereby a smaller force acts on the hoisting rope than when it is hanging free, due to which the flexible element 13 may lengthen. In such a case, the flexible element 13 lifts the auxiliary suspension element 12 in relation to the fastening structure 8 compared to the neutral position and thus shortens the distance between the sheave 5 or wedge socket 4 and the fastening structure 8 of the hoisting device body, which in turn may be detected by the detection means 17. Manual lightening refers to lightening or affecting the hoisting rope in the lifting direction, which an operator is able to carry out without any special strength or aids, with one hand, for example. Depending on the embodiment and the force used, the hoisting rope 3 or part thereof may be lifted, or the force acting on the rope and directed downward will lessen. Advantageously, the force required to displace the flexible element 13 is so small that an operator may displace the flexible element 13 by controlling the hoisting rope 3 up or down with one hand.

Correspondingly in an embodiment, the control unit 7 may be adapted to detect manual pulling down of the hoisting rope 3 on the basis of the lengthening of the distance between the sheave 5 or wedge socket 4 and the fastening structure 8 of the hoisting device body, detected by the detection means 17, compared to the neutral position where no external force is acting on the hoisting rope 3. Depending on the embodiment, this may be caused by the flexible element 13 compressing to a position shorter than the neutral position, as in the embodiment of FIGS. 3 to 5, or stretching to a position longer than the neutral position, as in the embodiment of FIGS. 5 to 6. In other words, the direction of displacement of the flexible element 13 may depend on whether the auxiliary suspension element 12 is adapted with the sheave 5 and/or wedge socket 4 on the opposite sides or the same side in relation to the fastening structure 8. The control unit 7 may in such a case be adapted to control the hoisting mechanism 6 to lower the hoisting rope in response to manual pulling of the hoisting rope.

In an embodiment, the control unit 7 may be adapted to detect providing of a load 25 on the hoisting rope 3, for example, directly to the hoisting rope 3 or load fastening means 26 adapted to the hoisting rope in response to a displacement of the flexible element 13 to a position where the sheave 5 or wedge socket 4, and consequently the load 25, too, have settled to be entirely supported by the main suspension element 11. Such a displaced position of the flexible element 13 may be detected on the basis of the distance, or a change therein, between the suspendable sheave 5 or wedge socket 4 and the fastening structure 8 of the hoisting device body. In an embodiment such as in connection with the device 10 shown in FIGS. 3 to 5, the control unit 7 may detect the providing of a load to the hoisting rope 3 based on a change in the distance between the suspendable sheave 5 or wedge socket 4 and the fastening structure 8 which is of such a magnitude that it indicates the main suspension element 11 having descended into contact with the fastening structure 8. In such a case, the suspension of the hoisting rope 3 is adapted to be entirely supported by the main suspension element 11, and the force seeking to lift the auxiliary suspension element 12 of the flexible element 13 is not sufficient to resist the force caused by the load provided on the hoisting rope. In a second embodiment, such as in connection with the device 10 shown in FIG. 6, the control unit 7 may detect the providing of a load to the hoisting rope 3 based on a change in the distance between the sheave 5 or wedge socket 4 and the fastening structure 8 which is of such a magnitude that it indicates the auxiliary suspension element 12 having descended into contact with the main suspension element 11 adapted to the fastening structure 8. In such a case, the suspension of the hoisting rope 3 is adapted to be entirely supported by the main suspension element 11, and the force seeking to lift the auxiliary suspension element 12 of the flexible element 13 is not sufficient to resist the force caused by the load adapted on the hoisting rope. In yet another embodiment, the device 10 may comprise a load detector (not shown), such as a sensor that is adapted to detect the arranging of a load 25 on the hoisting rope 3. The load detector may, for example, comprise a sensor, such as a pressure sensor, humidity sensor or another suitable sensor, which may be adapted to indicate the settling of the load 25 to be entirely supported by the main suspension element 11, or to indicate in another way the arranging of the load 25 to the hoisting rope 3. In an embodiment, the control unit 7 may in such a case be adapted to interrupt the control of the vertical movement of a hoisting rope 3, which is based on the distance between the suspendable sheave 5 or wedge socket 4 and the fastening structure 8 of the body of the hoisting device, or a change in the distance, in response to detecting that a load has been provided on the hoisting rope 3.

Figure 8:
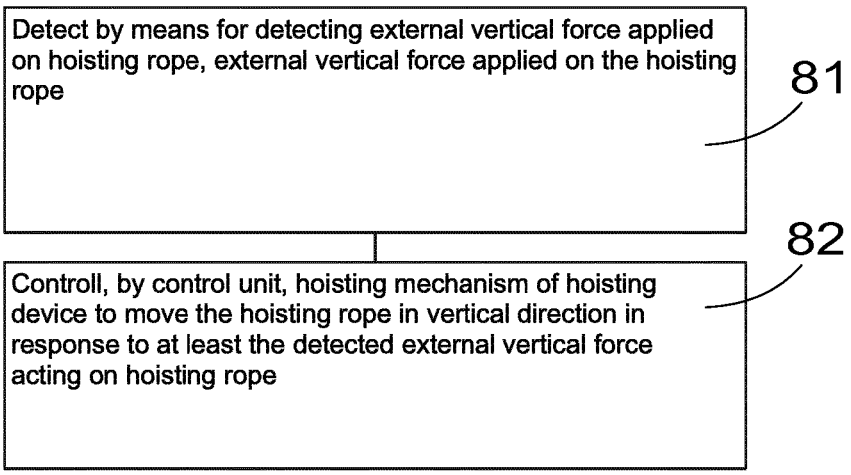
FIG. 8 shows a method for controlling the vertical movement of a hoisting rope of a hoisting device.

FIG. 8 shows a method for controlling the vertical movement of a hoisting rope of a hoisting device. In the method, an external vertical force applied on a hoisting rope may be detected 81 by the means 30 for detecting an external vertical force applied on the hoisting rope. Any device 10 described in this specification may have been adapted in the hoisting device, in connection with, for example, the sheave 5 or wedge socket 4 supporting the hoisting rope 3, to detect an external vertical force directed on the hoisting rope 3 of the hoisting device. In the method, by control unit 7 may control 82 the hoisting mechanism 6 of the hoisting device to move the hoisting rope 3 in the vertical direction in response to at least detecting an external vertical force applied on the hoisting rope.

In an embodiment, the means 30 for the detection of an external vertical force applied on the hoisting rope may comprise detection means 17 for detecting the distance between the suspendable sheave 5 or wedge socket 4 and the fastening structure 8 of the hoisting device body, or a change in the distance. In the method, the control unit 7 may control 82 the hoisting mechanism 6 of the hoisting device to move the hoisting rope 3 in the vertical direction in response to at least detecting a change in the distance between the suspendable sheave 5 or wedge socket 4 and the fastening structure 8 of the hoisting device body.

In an embodiment, through the user interface 52 of the control unit 51, a control command may in the method be received in response to the user interface of the remote controller 51 having been acted on, forward the control command to the to control unit 7, and control by the control unit 7 the hoisting mechanism 6 to move the hoisting rope 3 in the vertical direction in response to simultaneous detection of an external vertical force applied on the hoisting rope and detection of a control command given by means of the user interface of the remote controller 51.

In an embodiment, the means 30 of an external vertical force applied on the hoisting rope comprise detection means for detecting the distance, or a change therein, between the suspendable sheave or wedge socket and the fastening structure of the hoisting device body.

In an embodiment, the control unit 7 may in the method further determine a reference value for the distance between the suspendable sheave 5 or wedge socket 4 and the fastening structure 8 of the body of the hoisting device in response to detecting a control command given with the user interface 52 of the remote controller 51, and control at the control unit 7 the hoisting rope 3 to go up or down in response to the direction of the change of the distance between the suspendable sheave or wedge socket and the fastening structure of the hoisting device body, compared to the reference value. A second embodiment may correspond with the disclosed embodiment, but the reference value may be a predetermined fixed distance value. Controlling the hoisting rope 3 may take place by means of the hoisting mechanism 6 and on the basis of control commands the control unit 7 gives to the hoisting mechanism 6.

In a method, it is further possible to determine at the control unit 7 the speed of movement of the hoisting rope 3 in response to the magnitude of the change of the distance between the suspendable sheave or wedge socket and the fastening structure of the hoisting device body, compared to the reference value.

In an embodiment, the control unit 7 may in the method detect manual lightening of the hoisting rope 3 on the basis of the shortening of the distance between the sheave 5 or wedge socket 4 and the fastening structure 8 of the hoisting device body, detected by the detection means 17, compared to the neutral position where no external force is acting on the hoisting rope. Depending on the embodiment, this may be caused by the flexible element 13 compressing to a position shorter than the neutral position, as in the embodiment of FIG. 6, or stretching to a position longer than the neutral position, as in the embodiment of FIGS. 3 to 5. In other words, the direction of displacement of the flexible element 13 may depend on whether the auxiliary suspension element 12 is adapted with the sheave 5 and/or wedge socket 4 on the opposite sides or the same side in relation to the fastening structure 8. In the method, the control unit 7 may in such a case control the hoisting mechanism 6 to lift the hoisting rope 3 in response to the manual lightening of the hoisting rope.

In an embodiment, the control unit 7 may in the method detect manual pulling down of the hoisting rope 3 on the basis of the lengthening of the distance between the sheave 5 or wedge socket 4 and the fastening structure 8 of the hoisting device body, detected by the detection means 17, compared to the neutral position where no external force is acting on the hoisting rope 3. Depending on the embodiment, this may be caused by the flexible element 13 compressing to a position shorter than the neutral position, as in the embodiment of FIGS. 3 to 5, or stretching to a position longer than the neutral position, as in the embodiment of FIG. 6. In other words, the direction of displacement of the flexible element 13 may depend on whether the auxiliary suspension element 12 is adapted with the sheave 5 and/or wedge socket 4 on the opposite sides or the same side in relation to the fastening structure 8. In the method, the control unit 7 may in such a case control the hoisting mechanism 6 to lower the hoisting rope 3 in response to the manual pulling of the hoisting rope.

In an embodiment, the control unit 7 may in the method detect the arranging of a load 25 on the hoisting rope 3 in response to the flexible element 13 displacing to a position where the suspendable sheave 5 or wedge socket 4 have settled to be entirely supported by the main suspension element 11, whereby the displaced position is detected on the basis of the distance, or a change therein, between the suspendable sheave 5 or wedge socket 4 and the fastening structure 8 of the hoisting device body, and to interrupt at the control unit 7 the control of the vertical movement of a hoisting rope, which is based on the distance, or a change therein, between the suspendable sheave or wedge socket and the fastening structure of the body of the hoisting device, in response to detecting that a load has been adapted on the hoisting rope. The device 10, arrangement 50, and method disclosed in an embodiment may thus be used to control a load-free hoisting rope 3, in particular, in other words when a load has not been adapted to the hoisting rope 3 directly or, for example, by means of load fastening means 26.

One embodiment relates to a computer program product containing a computer-executable program code to be executed on a computer, which, when executed on the computer, provides operations according to the solutions disclosed in this specification. The computer program may be executed on a computer or processing means, adapted in connection with the hoisting apparatus such as the control unit 7. The computer program may be in a source code form, an object code form or an intermediate form, and it may be stored in some kind of a transmission means, which may be any entity or device capable of storing the program. Such transmission means comprise for instance a storing medium, computer memory, read-only memory, electric carrier wave, data communications signal and software distribution package. The memory may be volatile memory or non-volatile memory, for example EEPROM, ROM, PROM, RAM, DRAM, SRAM, firmware and/or programmable logic.

The device 10, arrangement 50, and method disclosed in an embodiment may be used to control a load-free hoisting rope, in other words, a hoisting rope to which no load has been adapted. The above embodiments and their features may also be combined. For example, a disclosed device 10, arrangement 51 or computer program product may be adapted to carry out at least some of the steps of a disclosed method, or a disclosed method may be adapted to be implemented with a disclosed device 10, arrangement 51, or computer program product.

A person skilled in the art will find it obvious that, as technology advances, the basic idea of the invention may be implemented in many different ways. The invention and its embodiments are thus not restricted to the above-described examples but may vary within the scope of the claims.

The invention claimed is:

1. A device for controlling the vertical movement of a hoisting rope in connection with a hoisting rope of a hoisting device comprising:

a main suspension element to suspend a sheave or wedge socket supporting the hoisting rope to a fastening structure of a hoisting device body;

a detector for detecting the distance between the suspendable sheave or wedge socket and the fastening structure of the hoisting device body, or a change in the distance, wherein an external vertical force acting on the hoisting rope is detectable by the detector; and a control unit configured to move the hoisting rope in a vertical direction based on the detected distance or the change in the distance.

2. The device as claimed in claim 1, further comprising:

an auxiliary suspension element attached in relation to the sheave or wedge socket in such a manner that the movement of the sheave or wedge socket is in each case transmitted to the auxiliary suspension element; and at least one element flexible in at least a longitudinal direction thereof, arranged to extend between the auxiliary suspension element and the fastening structure of the hoisting device body and in a direct or indirect contact with the auxiliary suspension element and the fastening structure of the hoisting device body such that the spring force of the flexible element acts on both the auxiliary suspension element and the fastening structure of the hoisting device body, wherein the flexible element is displaceable by applying an external vertical force on the hoisting rope, and wherein said external vertical force may be detected on the basis of the distance, or a change therein, between the sheave or wedge socket and the fastening structure of the hoisting device body.

3. The device as claimed in claim 2, wherein the elastic constant of the flexible element is chosen such that an external vertical force of the magnitude of 5 N applied on the hoisting rope is sufficient to displace the flexible element in such a manner that the detection means detect a change in the distance between the sheave or wedge socket and the hoisting device body, caused by the change in length of the flexible element, but that an external vertical force of the magnitude of 100 N applied on the hoisting rope is not sufficient to displace the flexible element into an extreme position of the flexible element.

4. The device as claimed in claim 2, wherein the flexible element comprises a spring.

5. The device as claimed in claim 2, wherein the auxiliary suspension element is arranged fixedly in relation to the main suspension element and on the opposite side of the main suspension element in relation to the suspendable sheave or wedge socket in such a manner that at least part of the auxiliary suspension element is arranged at a distance from the main suspension element.

6. The device as claimed in claim 2, wherein the auxiliary suspension element is arranged movably in relation to the main suspension element and substantially immovably in relation to the suspendable sheave or wedge socket, and on the same side as the sheave of wedge socket in relation to the fastening structure of the hoisting device body.

7. The device as claimed in claim 1, wherein the detector detects an external vertical force applied on the hoisting rope, and wherein said detector comprises at least one of a strain gauge, force sensor, distance sensor, pressure sensor, inductive distance sensor, ultrasonic sensor, capacitive sensor, magnetic inductive sensor, cable pull sensor, Hall sensor, optical distance sensor, sensor based on a conductor, laser measurement, and microswitch arrangement.

8. The device as claimed in claim 1, further comprising a hoisting mechanism for moving the hoisting rope, wherein the control unit is adapted to control the hoisting mechanism to move the hoisting rope in the vertical direction in response to at least detecting an external vertical force applied on the hoisting rope.

9. The device as claimed in claim 8, further comprising:

a remote controller, providing a user interface by means of which an operator is able to affect the remote controller in order to give control commands to the control unit, wherein the control unit is further adapted to control the hoisting mechanism to move the hoisting rope in the vertical direction in response to simultaneous detection of an external vertical force applied on the hoisting rope and detection of a control command given by means of the user interface of the remote controller.

10. The device as claimed in claim 8, wherein the control unit is further adapted to:

determine a reference value for the distance between the suspendable sheave or wedge socket and the fastening structure of the hoisting device body in response to detecting a control command given with the user interface of the remote controller; and control the hoisting rope to go up or down in response to the direction of the change of the distance between the suspendable sheave or wedge socket and the fastening structure of the hoisting device body, compared to the reference value.

11. The device as claimed in claim 10, wherein the control unit is further adapted to:

determine a speed of movement of the hoisting rope in response to the magnitude of the change of the distance between the suspendable sheave or wedge socket and the fastening structure of the hoisting device body, compared to the reference value.

12. The device as claimed in claim 8, wherein the control unit is further adapted to:

detect a manual lightening of the hoisting rope on the basis of the change of the distance between the sheave or wedge socket and the fastening structure of the hoisting device body, detected by the detection means, compared to a neutral position where no external force is acting on the hoisting rope; and control the hoisting mechanism to lift the hoisting rope in response to the manual lightening of the hoisting rope.

13. The device as claimed in claim 8, wherein the control unit is further adapted to:

detect manual pulling down of the hoisting rope on the basis of the changing of the distance between the sheave or wedge socket and the fastening structure of the hoisting device body, detected by the detection means, compared to a neutral position where no external force is acting on the hoisting rope; and control the hoisting mechanism to lower the hoisting rope in response to the manual pulling of the hoisting rope.

14. The device as claimed in claim 8, wherein the control unit is further adapted to:

detect a load on the hoisting rope in response to a dis-placement of the flexible element to a position where the suspendable sheave or wedge socket has settled to be entirely supported by the main suspension element, wherein a compressed position is detected on the basis of the distance, or a change therein, be-tween the suspendable sheave or wedge socket and the fastening structure of the hoisting device body; and interrupt the control of the vertical movement of the hoisting rope, which is based on the distance, or a change therein, between the suspendable sheave or wedge socket and the fastening structure of the hoisting device body, in response to detecting that a load has been provided on the hoisting rope.

15. A method for controlling the vertical movement of a hoisting rope of a hoisting device, wherein the device in accordance with claim 1 has been arranged in connection with the sheave or wedge socket supporting the hoisting rope of the hoisting device, to detect an external vertical force directed on the hoisting rope of the hoisting device, and wherein the method comprises:

detecting the distance between the suspendable sheave or wedge socket and the fastening structure of the hoisting device body, or a change in the distance with the detector; and controlling, by the control unit, a hoisting mechanism of the hoisting device to move the hoisting rope in the vertical direction in response to at least detecting an external vertical force applied on the hoisting rope.

16. The method as claimed in claim 15, further comprising:

receiving a control command through a user interface of a remote controller in response to the user interface of the remote controller having been acted on;

conveying the control command to the control unit; and controlling, by the control unit, the hoisting mechanism to move the hoisting rope in the vertical direction in response to simultaneous detection of an external vertical force applied on the hoisting rope and detection of a control command given by means of the user interface of the remote controller.

17. The method as claimed in claim 15, further comprising:

determining, in the control unit, a reference value for the distance between the suspendable sheave or wedge socket and the fastening structure of the hoisting device body in response to detecting a control command given with the user inter-face of the remote controller; and controlling, in the control unit, the hoisting rope to go up or down in response to a direction of the change of the distance between the suspendable sheave or wedge socket and the fastening structure of the hoisting device body, compared to the reference value.

18. The method as claimed in claim 17, further comprising:

determining, in the control unit, a speed of movement of the hoisting rope in response to the magnitude of the change of the distance between the suspendable sheave or wedge socket and the fastening structure of the hoisting device body, com-pared to the reference value.

19. The method as claimed in claim 15, further comprising:

detecting, in the control unit, a manual lightening of the hoisting rope on the basis of the changing of the distance between the sheave or wedge socket and the fastening structure of the hoisting device body, detected by the detection means, compared to a neutral position where no external force is acting on the hoisting rope; and controlling, by the control unit, the hoisting mechanism to lift the hoisting rope in response to the manual lightening of the hoisting rope; and/or detecting, at the control unit, manual pulling down of the hoisting rope on the basis of the changing of the distance between the sheave or wedge socket and the fastening structure of the hoisting device body, detected by the detection means, compared to a neutral position where no external force is acting on the hoisting rope; and controlling, in the control unit, the hoisting mechanism to lower the hoisting rope in response to the manual pulling of the hoisting rope.

20. The method as claimed in claim 15, further comprising:

detecting, in the control unit, providing of a load on the hoisting rope in response to a displacement of the flexible element to a position where the suspendable sheave or wedge socket has settled to be entirely supported by the main suspension element, wherein the compressed position is detected on the basis of the distance, or a change therein, between the suspendable sheave or wedge socket and the fastening structure of the hoisting device body; and interrupting, at the control unit, the control of the vertical movement of the hoisting rope, which is based on the distance, or a change therein, between the suspendable sheave or wedge socket and the fastening structure of the hoisting device body, in response to detecting that a load has been provided on the hoisting rope.

21. A computer program product, wherein the computer program product is stored on a non-transitory computer-readable media and executable by a processor, the computer program product comprising a computer-readable program code that is arranged to perform said steps of the method according to claim 15, when the program code is run in the processor.

* * * * *